US006532920B1

(12) United States Patent
Sweetnam et al.

(10) Patent No.: US 6,532,920 B1
(45) Date of Patent: Mar. 18, 2003

(54) MULTIPOSITIONAL LIFT ROCKER ARM ASSEMBLY

(75) Inventors: Gordon William St John Sweetnam, Plymouth, MI (US); Matthew Byrne Diggs, Farmington Hills, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/063,871

(22) Filed: May 21, 2002

Related U.S. Application Data

(60) Provisional application No. 60/355,197, filed on Feb. 8, 2002.

(51) Int. Cl.[7] ..... F01L 1/18

(52) U.S. Cl. ..... 123/90.16; 123/90.43; 123/90.46

(58) Field of Search ..... 123/90.39–90.46, 123/90.15–90.18, 90.36

(56) References Cited

U.S. PATENT DOCUMENTS

| | | | | |
|---|---|---|---|---|
| 4,587,934 A | | 5/1986 | Moores | 123/90.18 |
| 5,419,290 A | | 5/1995 | Hurr et al. | 123/90.16 |
| 5,515,820 A | | 5/1996 | Sugimoto et al. | 123/90.16 |
| 5,529,033 A | * | 6/1996 | Hampton | 123/90.16 |
| 5,544,626 A | | 8/1996 | Diggs et al. | 123/90.16 |
| 5,655,488 A | * | 8/1997 | Hampton et al. | 123/90.16 |
| 5,657,726 A | | 8/1997 | Diggs et al. | 123/90.36 |
| 5,682,848 A | * | 11/1997 | Hampton et al. | 123/90.16 |
| 5,960,755 A | | 10/1999 | Diggs et al. | 123/90.15 |
| 5,979,379 A | | 11/1999 | Sato et al. | 123/90.16 |

* cited by examiner

*Primary Examiner*—Thomas Denion
*Assistant Examiner*—Kyle M Riddle
(74) *Attorney, Agent, or Firm*—Dykema Gossett PLLC; Carlos L. Hanze

(57) ABSTRACT

A multiple lift position rocker arm 307 is provided which includes a body 10 and a pivotally mounted lost motion arm 44. A latch 120 is connected on one end of the body to prevent pivotal movement of the arm 344 with respect to the body 10 in a first given angular direction. The latch 120 has a second position to allow the arm 344 to pivot relative to the body to activate a valve stem 18 in a second state of activation. Preferably a roller 356 is connected with the arm 344 and rollers 162 are connected with the body 10. Roller 356 makes contact with a cam lobe in the first state of activation of the rocker arm assembly 307. The rollers 162 make contact with a cam lobe when the rocker arm assembly is in a second state of activation.

22 Claims, 7 Drawing Sheets

MULTIPOSITIONAL LIFT ROCKER ARM ASSEMBLY

CROSS REFERENCE TO RELATED APPLICATIONS

This application claims the benefit of U.S. Provisional Application Serial No. 60/355,197 filed Feb. 8, 2002.

BACKGROUND OF INVENTION

The field of the present invention is rocker arm assemblies for internal combustion engines and more particularly, rocker arm assemblies for internal combustion engines that can selectively switch between high lift and low lift valve operation.

Rocker arms transmit motion from a rotating cam shaft to a stem of a poppet valve to open and close the valve. Almost universally, the valve is spring-biased shut and the cam via the rocker arm controls the opening and closing of the valve. One type of rocker arm is the finger follower rocker arm.

In recent times, finger follower and other types of rocker arms have been made to selectively totally or partially deactivate to allow enhanced control of vehicle engines in regard to emissions and fuel economy.

In one such rocker arm assembly, the rocker arm has an outer body that engages the valve stem and an inner, lost motion arm pivotally mounted on and within the outer body for movement relative to the outer body. The lost motion arm is spring-biased upward against an overhead engine cam center lobe to be pivoted by the same. A latch mechanism with an extendable plunger is positioned within the outer body. The plunger is normally in a position to limit movement of the lost motion arm relative to the outer body so that the cam lobe can pivot the outer body and lost motion arm together. as an integral unit to activate the valve stem. Withdrawal of the latch mechanism plunger allows the lost motion arm to freewheel in a lost motion manner without causing partial or full movement of the outer body and valve stem.

In Diggs et al. U.S. Pat. No. 5,960,755, commonly assigned and incorporated herein by reference, a rocker arm assembly and method of utilization for high lift and low lift exhaust valve operation is disclosed. (The terms long duration and short duration are sometimes substituted for the terms high lift and low lift.) In the rocker arm assembly of Diggs et al., the duration that the exhaust poppet valve is open and the valve's maximum displacement during its opening can be selectively changed. For the high lift operation, a cam lobe makes contact with the lost motion arm while the lost motion arm is prevented from rotating relative with the outer body by the latch plunger. When shorter duration operation is desired, the latch mechanism retracts the plunger. The lost motion arm is now allowed to pivot freely with respect to the outer body.

Accordingly, the cam lobe now makes contact directly with the outer body. In most instances, separate cam lobes make contact with the outer body than the cam lobe which makes contact with the lost motion arm so that a phase change may automatically be placed into the valve train system.

The body of the rocker arm assembly of Diggs et al. has contact slider pad engagement with the cam lobe during the short duration operation. Although slider pad contact is acceptable, from a wear standpoint it is preferable to have rolling contact engagement between the short duration cam lobe and body.

A major consideration for using the Diggs et al. finger follower rocker arms is that lateral spaces available for placement of a dual lift position rocker arm assembly are extremely limited (especially for in-line multi-valve engines with two or more intake or exhaust valves per cylinder). Therefore, it is highly desirable that the lateral width of the rocker arm assembly be reduced without compromising any strength requirements of the assembly.

Another consideration for rocker arm assemblies is that the upward movement of the lost motion arm with respect to the outer body be limited and set as accurately as possible. Accordingly, the rocker arm design which can be machined at low cost while meeting stringent dimensional tolerance levels is desired when setting the angle stop of the lost motion arm with respect to the remainder of the outer body.

SUMMARY OF INVENTION

To make manifest the above delineated and other desires, a revelation of the present invention is brought forth. In a preferred embodiment, the rocker arm assembly provides a longitudinal extending body. The body engages adjacent a first end with an engine valve stem to activate the same. Opposite the first end, the body engages with a pivot fulcrum.

A lost motion arm is provided that pivotally connects to the first end of the body. The lost motion arm is spring-biased by torsion springs into engagement with a stop surface. For high lift and low lift operations it is preferred to keep the inner arm from contacting the high lift cam lobe base circle.

The lost motion arm has a forked body. An elongated aperture extends through the forks of the lost motion arm. A sleeve is press-fitted within the aperture and rotatably connects a roller which is mounted on the sleeve by a needle bearing arrangement. A shaft eccentrically passes through the aperture. The shaft is press-fitted through aligned apertures passing through the main body. On opposite extreme ends, rollers are rotatably connected on the shaft.

The shaft performs two major functions. First, it allows rollers to be rotatably connected with the main body which accordingly enhance the wear characteristic of the rocker arm assembly. This eliminates the sliding contact of the main body with a cam lobe, as brought forth in the prior rocker arm of Diggs et al. Second, through contact with the inner diameter of the lost motion arm sleeve, the shaft acts as an angular stop surface for the lost motion arm.

A preferred embodiment multi-positional rocker arm assembly according to the present invention is advantageous in that it has rollers rotatably connected with the main body for rolling contact with the cam lobe when the rocker arm assembly is being utilized in the low lift mode of operation.

Additionally, the preferred embodiment of the present invention is also advantageous due to the angular limits of the motion of the lost motion arm with respect to the outer body. Accurately limiting the angular displacement of the lost motion arm downward with respect to the outer body helps eliminate the condition referred to as submarining. Submarining occurs when the lost motion arm is inadvertently held underneath an extended plunger, which is more likely when the lost motion arm swings higher than a maximum desired amount. If submarining occurs, the rocker arm assembly is locked permanently in low lift operation.

The shaft also serves as a stop to limit the engagement of the arm (via a slider pad or a roller) from contacting the cam lobe base circle. The dimensions and tolerance of the rocker arm assembly and the camshaft are controlled to ensure that the high lift cam lobe base circle never contacts the high lift follower (which is the lost motion arm slider pad or roller surface). As the lash adjuster compensates for tolerances and thermal effects, the lost motion arm remains at a nearly constant distance from the high lift cam base circle. This configuration is required to allow the roller on the lost motion arm to freewheel during low lift operation without having the lash adjuster pump up improperly.

Other features and advantages of various embodiments of the present invention will become more apparent to those skilled in the art from a reading of the following detailed description and upon reference to the drawings.

DETAILED DESCRIPTION

Figure 1:
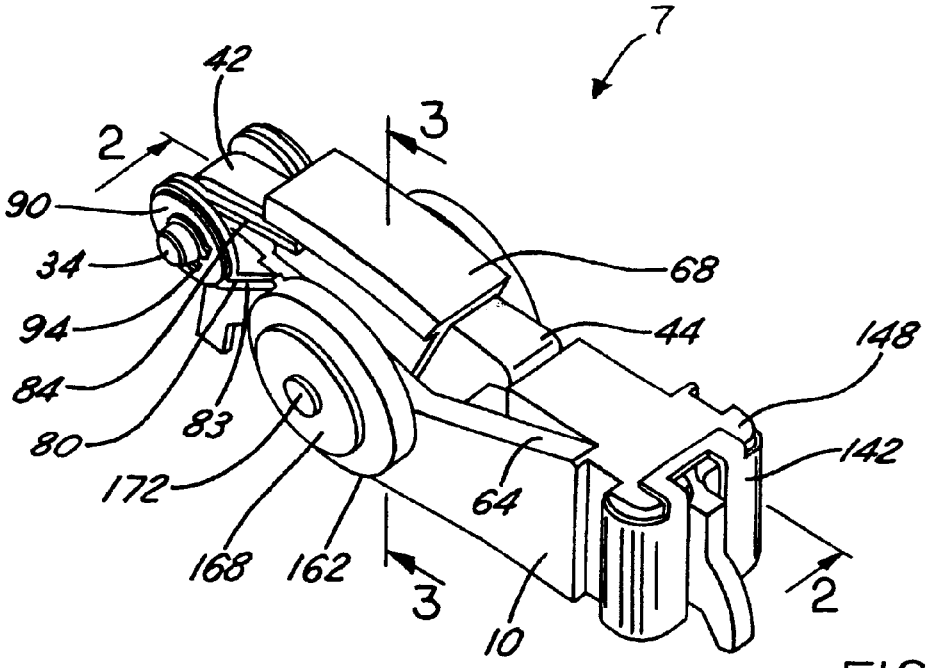
FIG. 1 is a top perspective view of a preferred embodiment rocker arm according to the present invention.
Figure 2:
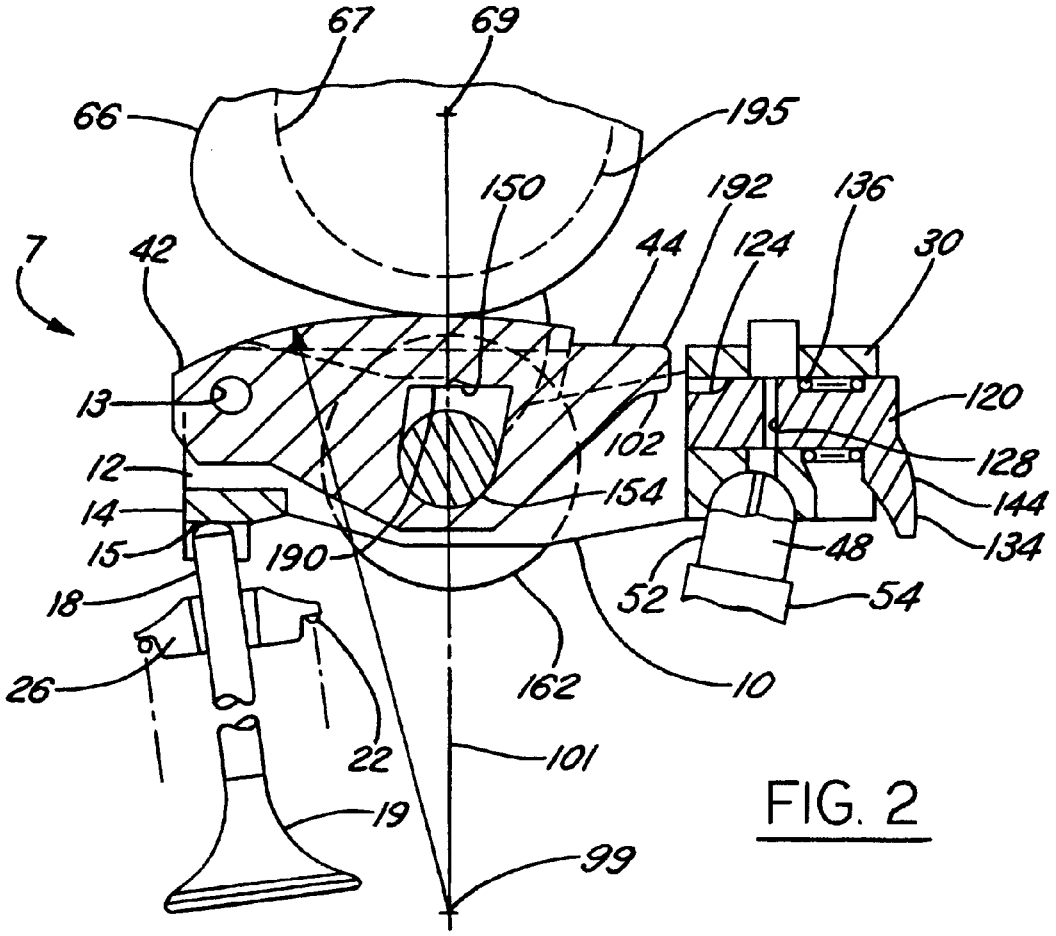
FIG. 2 is a sectional view taken along lines 2—2 of FIG. 1 with a lost motion arm nearly at its uppermost angular position.
Figure 3:
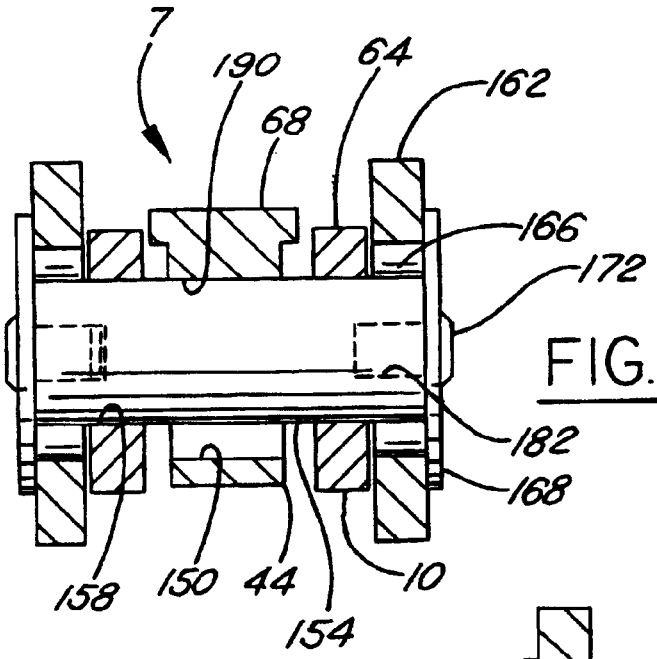
FIG. 3 is a view taken along lines 3—3 of FIG. 1 with the lost motion arm moved to its lowermost angular position for purposes of illustration.

FIGS. 1 through 3 illustrate an internal combustion engine rocker arm assembly 7 according to the present invention. The rocker arm assembly 7 has a forked shaped body 10 which is often referred to as a cradle or outer arm. The body has twin ears 12 (FIG. 2). The ears 12 have a transverse bore 13. The body 10 has a first end 14. The body first end 14 as best shown in FIG. 2 engages with a valve stem 18 via a convex contact surface 15 (only partially shown) to activate a poppet valve 19. The valve stem 18 is biased generally upward by a spring 22 which is captured by a valve stem collar 26. The upward biasing of the valve stem 18 places the valve 19 in a closed position to prevent fluid communication through a port to a combustion chamber (not shown) of the engine. To open the poppet valve, the body first end 14 will pivot in a generally counter-clockwise direction.

The body 10 has an opposite second end 30. The second end 30 engages with a pivot fulcrum 48. The pivot fulcrum 48 is provided by a plunger portion 52 of a hydraulic lash adjuster 54. The body second end 30 has a spherical socket receiving the plunger 52. The lash adjuster 54 constitutes a stationary fulcrum for pivotal movement of the body 10 of the rocker arm assembly in a manner to be described.

An inner or lost motion arm 44 is pivotally connected to the first end 14 of the body 10. A pin 34 passes through bore 13 and a corresponding bore in the lost motion arm 44. A lever end 42 of the lost motion arm is pivotally connected by the pin 34. The lost motion arm 44 fits in between fork like lobes 64 of the body. The lost motion arm 44 is spring biased arcuately in a counter-clockwise direction as shown in FIG. 1 to have contact with a rotatable cam lobe 66. The cam lobe 66 is rotated by a camshaft 67 that is powered by the engine.

To make contact with the cam lobe 66, the lost motion arm 44 has a slider pad 68. The lost motion arm 44 is spring biased into the cam lobe 66 by coil torsion springs 80. The coil torsion springs 80 have a first leg 83 which pushes against the body 10. The springs 80 have a second leg 84 which interacts with the lost motion arm 44 to urge it in a counter-clockwise direction. The springs 80 encircle the pin 34 and are mounted on the dual heads 90 of the pin. The heads 90 are held in position on the pin 34 by a retention washer 94.

The second end 30 of the body 10 also has a latch mechanism. The latch mechanism includes an extendable plunger 120. The plunger 120 has an upper first contact surface 124. The plunger 120 also has a transverse bore 128 to allow for the cumulative flow of lubricating oil therethrough. The plunger 120, as shown in FIG. 2, has an extended (leftward) first position wherein its first contact surface 124 makes contact with a first contact surface 102 of the lost motion arm. In the first position, the plunger 120 prevents relative angular motion of the lost motion arm 44 with respect to the body 10 in a clockwise direction. The plunger 120, as best shown in FIG. 2, has a second position which is non-contacting with the lost motion arm 44 to allow the lost motion arm 44 to pivot clockwise relative to the body 10.

The plunger 120 has fixably connected thereto a latch pin 134. A spring 136 encircles the plunger 120 in its position within a bore of the body 10. The spring 136 urges the latch pin 134 to the right, as shown in FIG. 2, to position the plunger 120 in its aforementioned second position. The plunger 120 is held to the body 10 by a latch pin retainer 142 that that clips onto a transverse ledge 148 of the body 10 (FIG. 1).

An activating system (not shown) includes an axle or shaft rotatable by a solenoid. The activating system further includes at least one activating arm disposed about and extending radially from the shaft to engage or disengage the latch pin 134. The activating arm has a contact surface which makes contact with a cylindrical surface 144 of the latch pin. The activating arm is urged into engagement with the latch pin by a helical coil spring disposed about the activator shaft. The latch pin and plunger 120 will be in the first position compressing the spring 136. When it is desirable for the plunger 120 to assume its second position shown in FIG. 2, the engine control unit will supply power to the activator solenoid to cause the activating arm to rotate away from the latch pin 134 to allow the spring 136 to move the plunger 120 to its second position. A more detailed explanation of the activating system can be found in Diggs et al.

The lost motion arm 44 has an aperture 150 transversely extending therethrough. Extending through the aperture is a shaft 154. The shaft 154 is press-fitted through aligned apertures 158 provided in the lobes 64 of the body. Mounted on the shaft 154 are rollers 162 that rotatably connect with the body 10. The rollers 162 are mounted on the shaft 154 by needle bearings 166. The needle bearings 166 are held in position by a cover 168. The cover 168 is connected with the shaft 154 by a pin 172.

Figure 4:
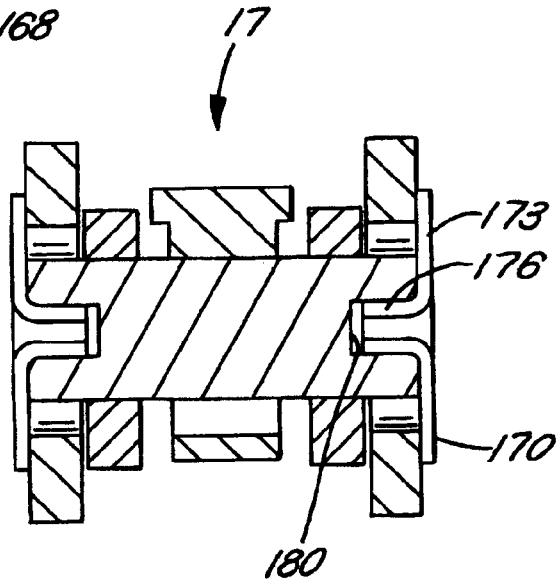
FIG. 4 is a view similar to that of FIG. 3 illustrating an alternative closure for needle bearings which are mounted on a shaft which extends through an outer body of the rocker arm assembly shown in FIGS. 1–3.

Referring to FIG. 4 with similar items being given similar reference numerals, a rocker arm assembly 17 has an alternate arrangement wherein a cover 170 has a flat region 173 and a cylindrical portion 176. The cover cylindrical portion 176 is press-fitted into position within a blind bore 180 of the shaft. The blind bore 180 does not have to be threaded, unlike the blind bore 182 shown in FIG. 3.

In another embodiment, not shown, the shaft is heat treated such that its outer ends are soft and stamped such that it peened over the outboard end of the cover 168 eliminating the need for a pin.

During normal operation, the lost motion arm upon valve activation will rotate clockwise with respect to the body (FIG. 2). The transverse aperture 150 in the arm 44 has a top end 190. Clockwise rotation of the lost motion arm 44 with respect to the body 10 will be limited by contact with the shaft 154, which stops a front portion of arm 44 from pivoting to a lower position. Therefore, the plunger 120 is unable to extend leftward where it could rest on top of upper end 192 of an extreme forward end of the lost motion arm and accordingly cause a submarining condition.

The fixturing which drills the apertures 158 (FIG. 3) through the lobes 64 of the body can be drilled or bored in a common machining operation. Therefore, the dimensional alignment of shaft 154 with the lobe 64 can be held to relatively tight tolerances in a simple machining operation. Since the lost motion arm 44 only has pivotal motion with respect to the body 10, the point of contact between the top end 192 of the lost motion arm and the shaft 154 can be set with a relative high degree of dimensional stability during the machining operation.

Figure 5:
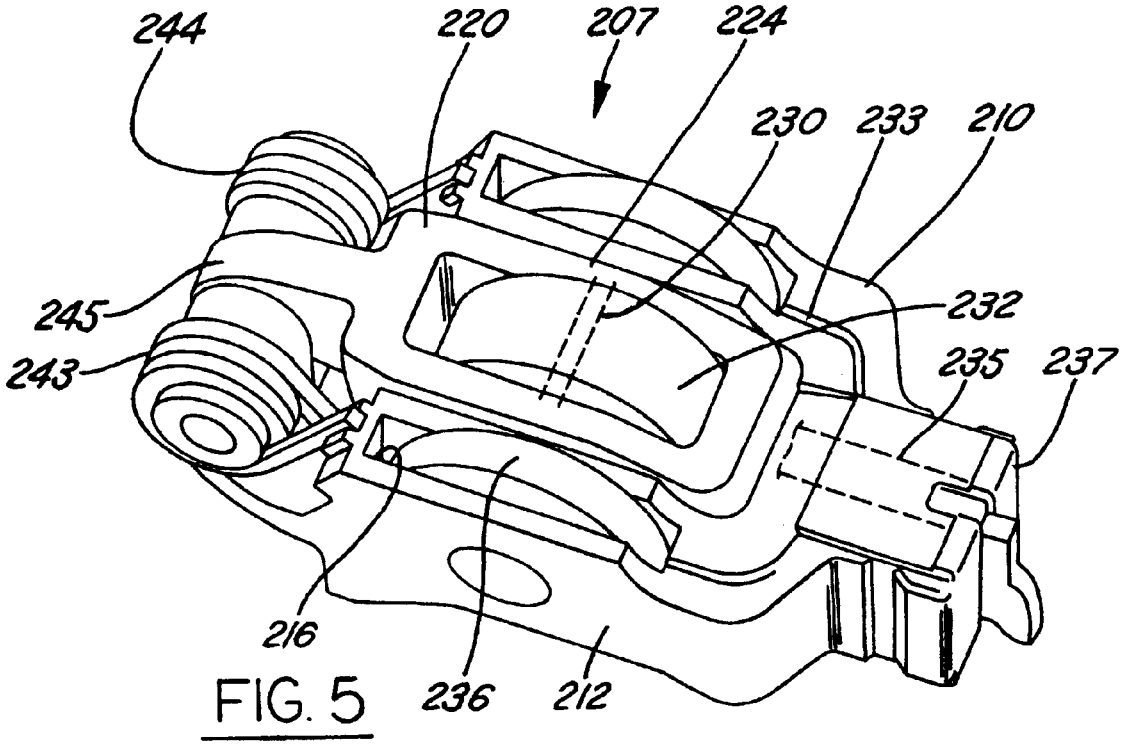
FIG. 5 is a perspective top view of an alternate preferred embodiment rocker arm assembly of the present invention.
Figure 6:
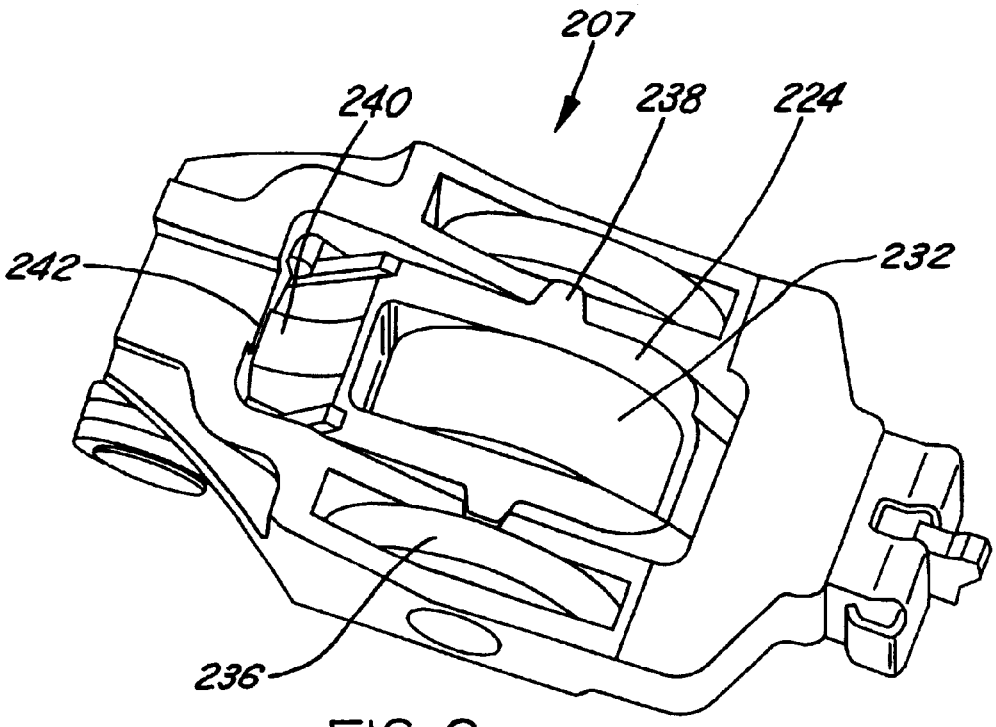
FIG. 6 is a bottom perspective view of the rocker arm assembly shown in FIG. 5.
Figure 7:
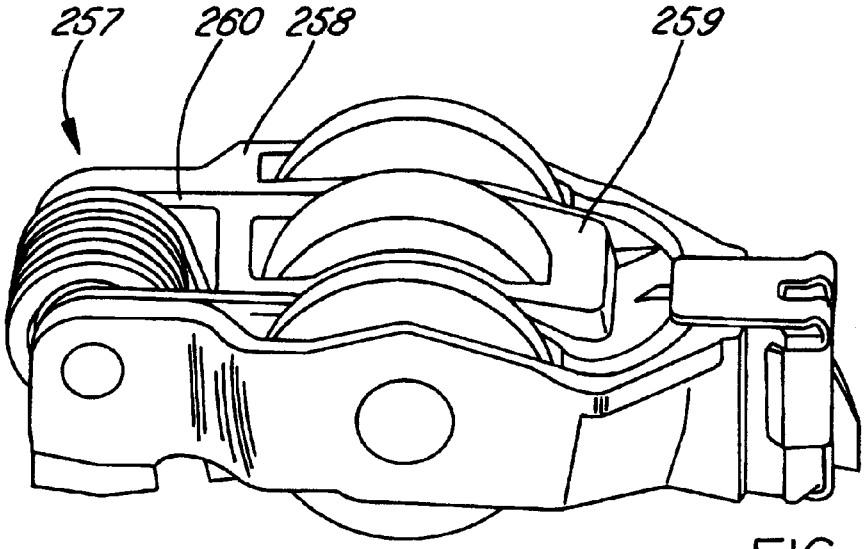
FIG. 7 is a perspective view of an alternate embodiment rocker assembly similar to that shown in FIGS. 5 and 6.
Figure 8:
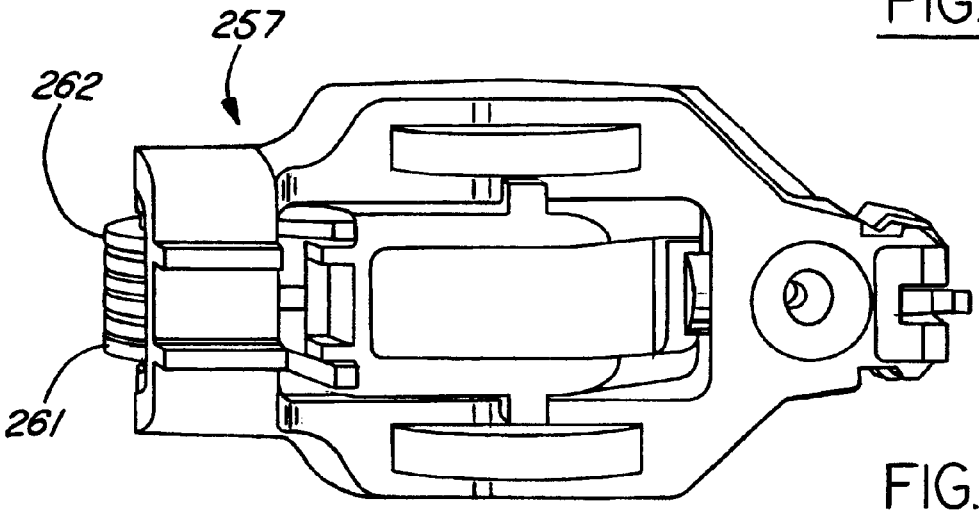
FIG. 8 is a bottom perspective view of the rocker arm assembly shown in FIG. 7.
Figure 9:
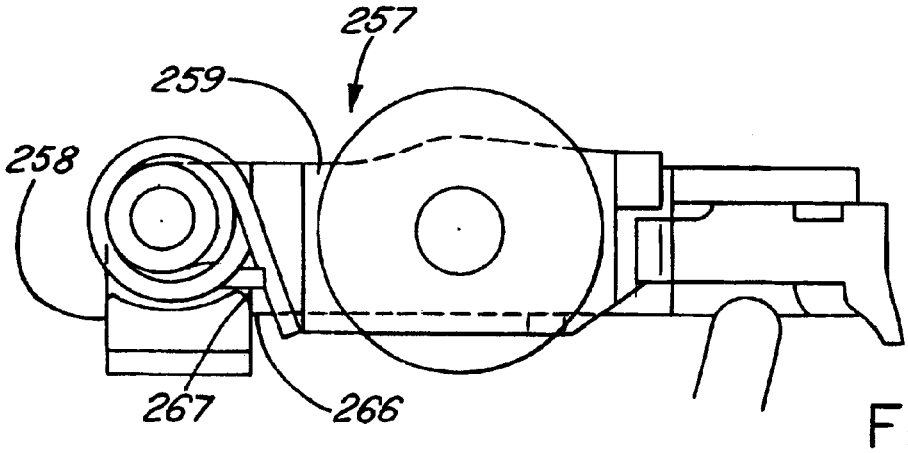
FIG. 9 is a partial sectional view of the rocker arm assembly shown in FIGS. 7–8.
Figure 10:
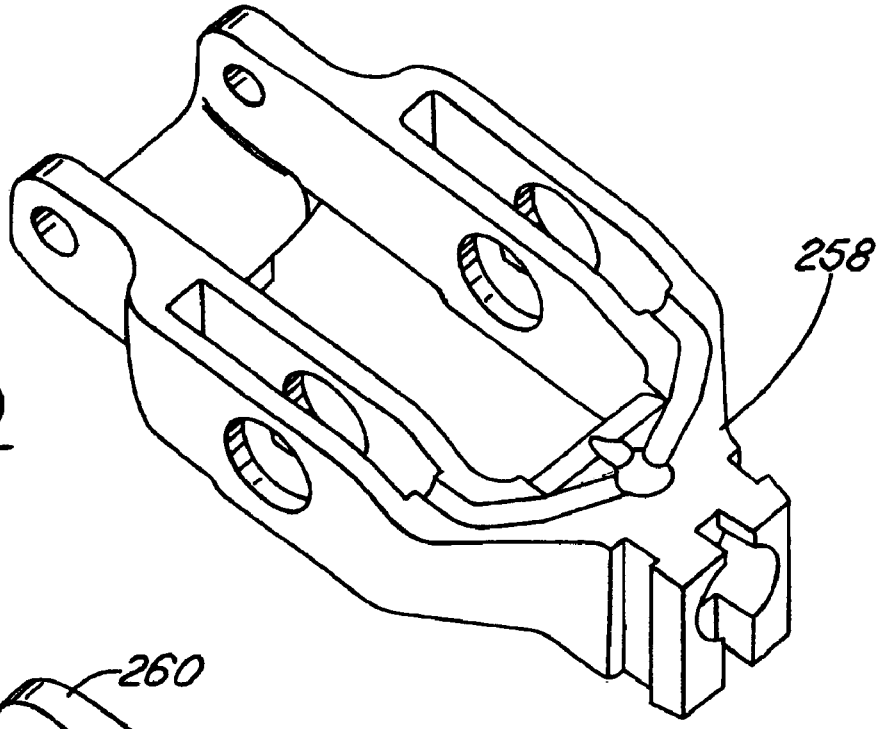
FIG. 10 is a perspective view of the rocker arm assembly shown in FIG. 6.
Figure 11:
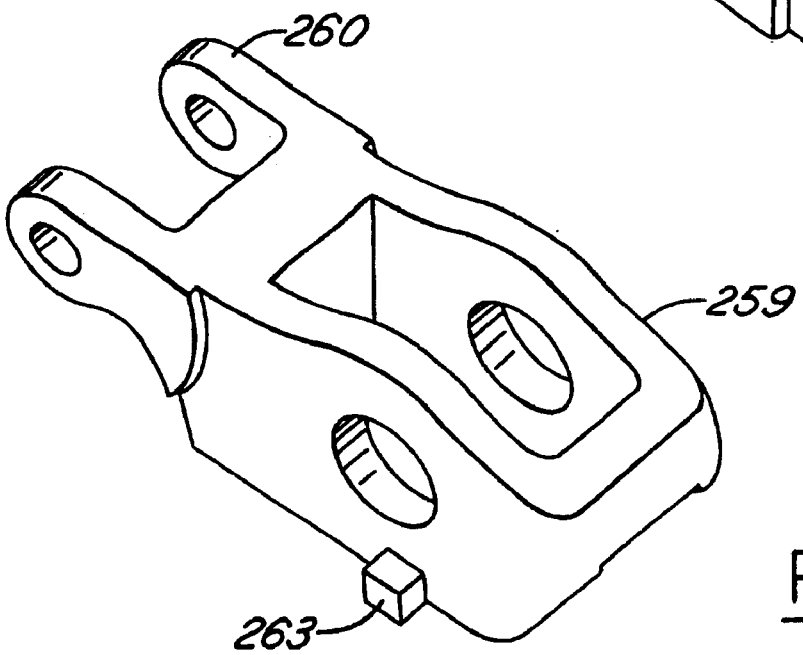
FIG. 11 is a perspective view of the rocker arm assembly shown in FIG. 7.

FIGS. 5 and 6 show an alternate preferred embodiment rocker arm assembly 207 according to the present invention. The rocker arm assembly 207 is essentially similar to rocker arm assembly 7 with certain changes. The rocker arm assembly 207 has a fork-like body 210 having lobes 212. The lobes 212 have a bifurcating pocket aperture 216. Assembly 207 also has a forked lost motion arm 220 that has lobes 224. The lobes have extending therebetween a connected shaft 230 which mounts a lost motion arm roller 232. The rocker arm assembly 207 has a series of oil grooves 233 that allow oil pumped through the lash adjuster to flow through a transverse hole in the plunger pin 235 (partially shown) to an area underneath a latch pin retainer 237 to the oil grooves 233. This process is described in commonly assigned Diggs, U.S. Pat. No. 5,657,726, the disclosure also being incorporated herein. The rollers 236 are rotatively mounted to the body 210 within the pocket apertures 216.

Rocker arm assembly 207 also differs from assembly 7 in that the rolling contact engagement of rollers 236 are rotatably connected to the body 210 and are positioned within the pocket apertures 216. An additional roller 232 is provided for rolling contact engagement when the lost motion arm is imparting a pivotal force to the outer body 212. Also, the lost motion arm has two laterally projecting studs 238 which prevent the lost motion arm 220 from pivoting too far upward (counterclockwise as shown in FIG. 5). The rocker arm assembly 207 lost motion arm has a section 240 to contact a section of the body 242 to provide a lower angular stop for the lost motion arm 220.

Referring to FIGS. 7–11, a rocker arm assembly 257 is provided. Rocker arm assembly 257 has a body 258 and lost motion arm 259. The lost motion arm 259 has two spread-apart pivot hinges 260. The spreading apart of the pivot hinges allows inboard mounting of the biasing springs 261,262 of the lost motion arm. This arrangement prevents entrapment of foreign matter into the springs, as opposed to the embodiment of rocker arm 207 which has its biasing springs 243, 244 mounted outboard of the single pivot hinge 245 of the lost motion arm.

The lost motion arm 259 has transverse studs 263 which perform an angular limiting function similar to that described for studs 238. In a similar manner, the lost motion arm has a contact section 266 which engages with a section 267 of the body to limit downward angular movement of the lost motion arm.

Figure 12:
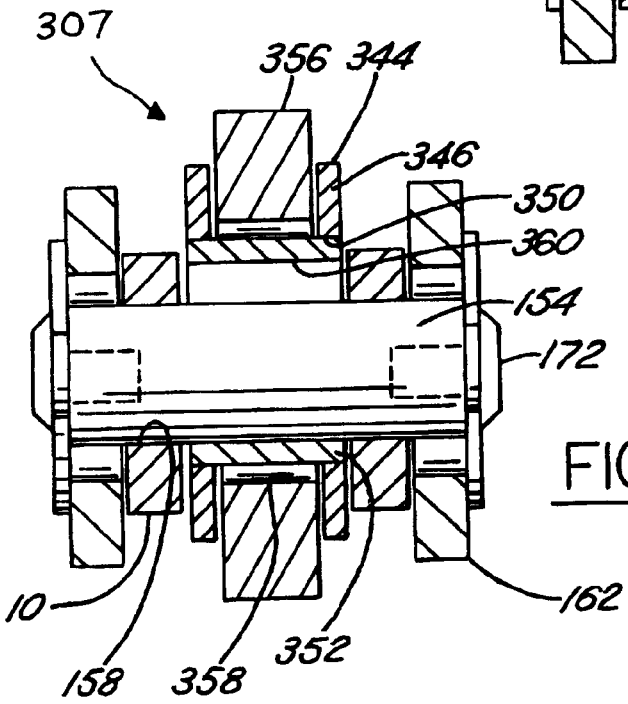
FIG. 12 is a view taken along lines 12—12 of FIG. 13 which is similar to FIG. 4 showing an alternate preferred embodiment rocker arm assembly of the present invention which incorporates the advantages of the present invention shown in FIGS. 1, 5 and 7. The lost motion arm is show at its uppermost position.
Figure 13:
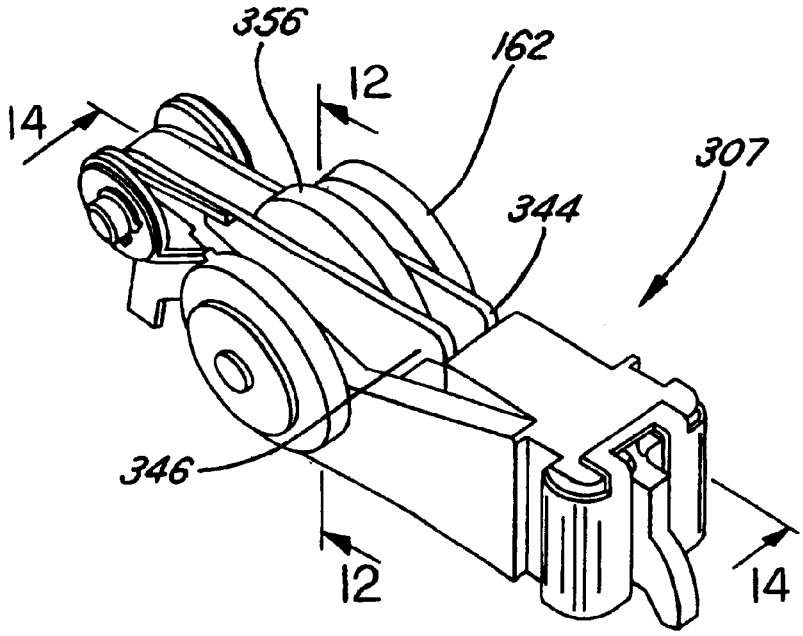
FIG. 13 is a perspective operational view of the rocker arm assembly of FIG. 12.
Figure 14:
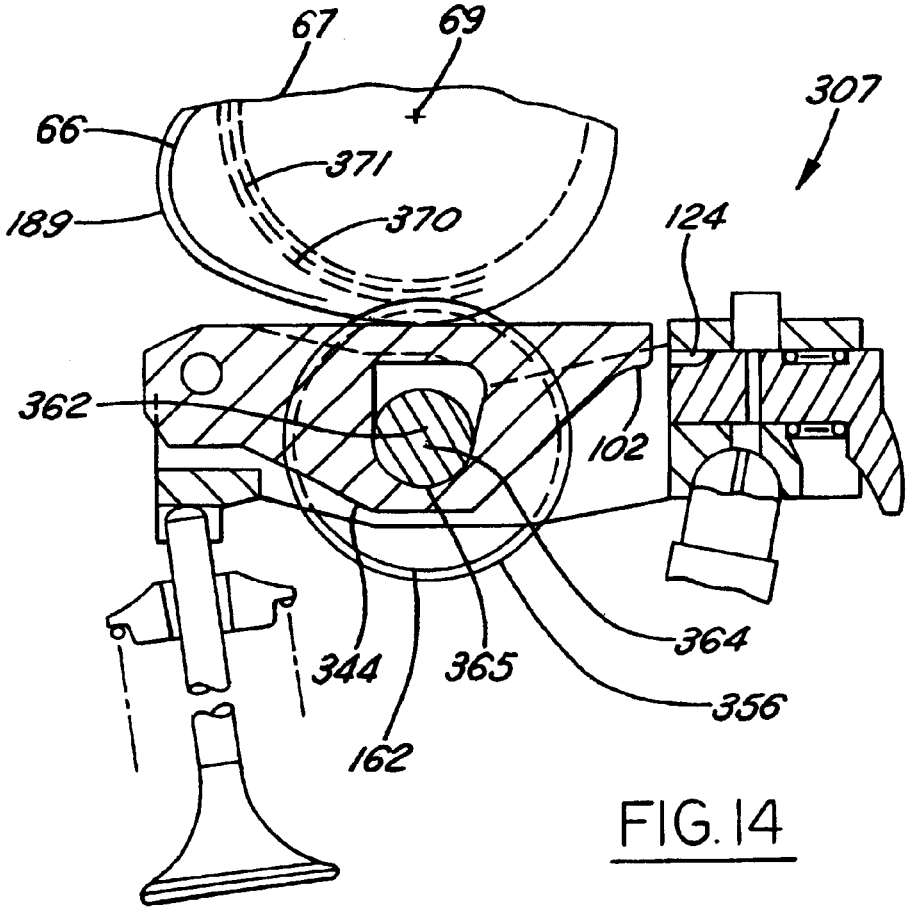
FIG. 14 is a view taken along line 14—14 of FIG. 13 with the lost motion arm moved nearly to its uppermost angular position for purposes of illustration.

Referring to FIGS. 12–14 an alternate preferred embodiment rocker arm assembly 307 which incorporates the advantages of rocker arm assemblies 7 and 257 is provided with like items given identical reference numerals. The rocker arm assembly 307 has a forked lost motion arm 344. Lost motion arm 344 has two lobes 346. Lobes 346 have an aligned cross aperture 350. Press-fitted within the aperture 350 is a sleeve 352.

The sleeve 352 has mounted thereon a central roller 356. The roller 356 is placed upon needle bearings 358. A top portion of the sleeve 360 acts in conjunction with the shaft 154 to provide the aforementioned limit on angular rotation. Additionally, the rocker arm assembly 307 has rolling contacting engagement with high lift cam lobe 66 or low lift cam lobe 189. Because no portion of the body is outboard from the rollers 162, rocker arm assembly 307 has a slim lateral profile.

During normal engine operation, the plunger 120 will be extended leftward from the position shown in FIGS. 2 and 12. The plunger first contact surface 124 will make contact with the lost motion arm first contact surface 102. Accordingly, the lost motion arm 44,344 is now limited in its clockwise movement with respect to the body 10.

In this first state of activation, a high lift (long duration) valve rotation of the cam lobe 66 causes the lost motion arm 44, 344 and the cam body 10 to pivot about the fulcrum 48 provided by the lash adjuster 54 and to rotate as a unit counter-clockwise, which causes the contact surface 15 to push downward on the valve stem 18 to open the valve 19. Upon further rotation of the cam lobe 66, the unit of the lost motion arm 44, 344 and the body 10 will rotate back in a clockwise direction, allowing the upward movement of the valve stem 18 to close the valve 19.

Referring again to FIGS. 2 and 12, when it is desired for valve 19 to move to a second state of activation, the engine control module (not shown) will activate the solenoid (not shown) to move the activator arm away from the latch pin 134. Accordingly, the spring 136 will move the plunger 120 to the position shown in FIG. 2. The lost motion arm 44, 344 by virtue of its interaction with the rotating cam 66 can now have clockwise angular movement with respect to the body 10 and will not impart angular motion to the body 10.

When it is desired to utilize the second state of activation feature of the rocker arm assembly 7, 307 to provide a shorter duration of activation of the valve 19 (low lift), common cam shaft cam lobes 189 (partially shown in FIG. 14 only) engage with rollers 162 of the body to give a short duration operation. This is best explained in Diggs et al., U.S. Pat. No. 5,960,755.

The rocker arm assembly 307 is configured in such a manner that the lost motion arm roller 356 has a rotational axis 362. The rollers 162 connected with the body 10 have a rotational axis 364. The cam shaft 67 has a rotational axis 69. When the lost motion arm is at its uppermost position causing the shaft 154 to strike on a lower end 365 of the aperture 150 the rotational axes 69, 362 and 364 will be on a common plane. Additionally, the lost motion arm roller 356 will always have a certain clearance with the base circle 371 of the high lift cam lobe 66.

The lash adjuster 54 compensates for tolerances and thermal effects and keeps the low lift rollers 356 in contact with the low-lift base circle 370 of the low lift cam 189. The clearance that the rollers 356 have with the base circle 371 of the high lift cam lobe 66 ensures that there is a gap between the plunger first contact surface 124 and the contact surface 102 of the lost motion arm 344.

Figure 15:
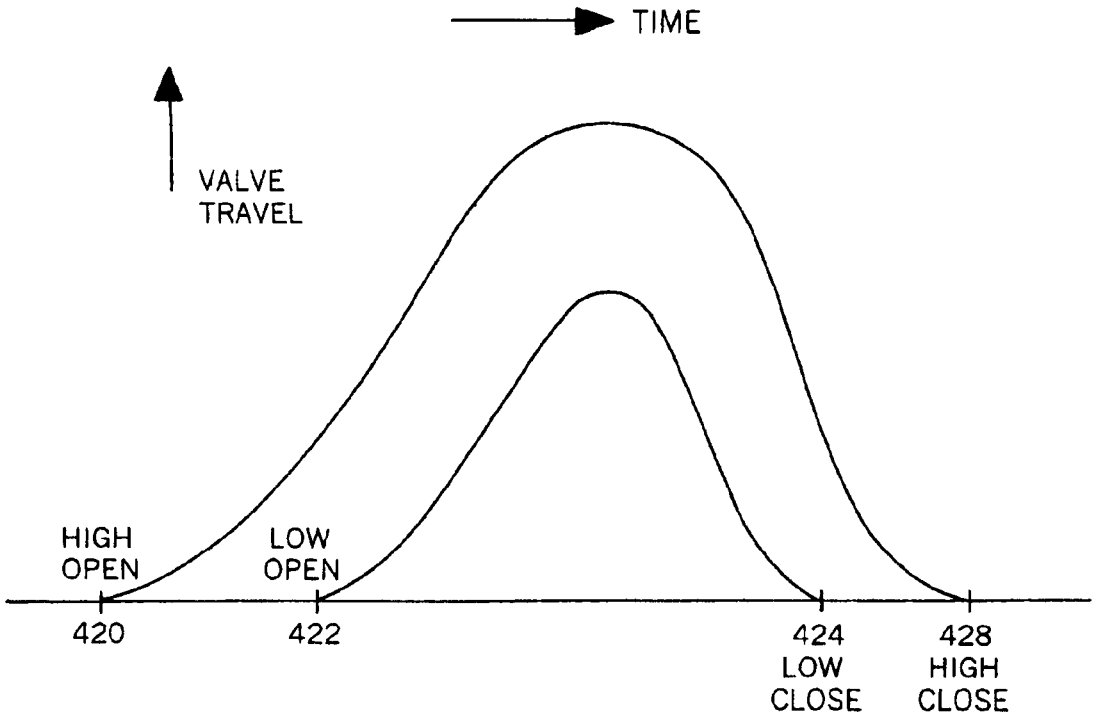
FIG. 15 is a diagram illustrating valve lift versus camshaft rotation for a long duration valve opening event and a short duration valve opening event.

In a similar manner, the embodiment 207 of FIGS. 5 and 6 when the lost motion arm 220 is at its uppermost position, show the roller 232 out of contact with the base circle 371 of the high lift cam lobe 66 to ensure a gap between the control arm contact surface and the contact surface of the latch pin. As mentioned previously, the gap between the base circle 371 of the high lift cam lobe 66 and the lost motion arm roller 356 also aids to prevent improper adjustment of the lash adjuster 54. The above alignment also aids to maintain symmetrical alignment of the high and low opening and closing valve events noted as points 420, 422, 424 and 428 on FIG. 15.

For the rocker arm assembly embodiment 7 (FIGS. 1–2) having a slider pad 68, when the lost motion arm is in its uppermost position, the radial center 99 of curvature of the slider pad 68 will be closely adjacent to or intersecting with a line 101 intersecting with the rotational center of the roller 162 and the center axis 69 of the cam shaft 66.

While preferred embodiments of the present invention have been disclosed, it is to be understood that they have been disclosed by way of example only and that various modifications can be made without departing from the spirit and scope of the invention as it is encompassed by the following claims.

What is claimed is:

1. A multiple lift position engine rocker arm assembly comprising:

a body engagable adjacent a first end with a valve stem, said body being engagable with a fulcrum adjacent an end opposite said first end;

an arm pivotally connected to one of said ends of said body, said arm being spring biased into engagement with a cam lobe, said arm having an aperture therein;

a latch connected on an end of said body generally opposite said arm pivotal connection to prevent angular movement of said arm with respect to said body in a first given angular direction to transmit movement of said arm by said cam to said body for a first state of activation of said valve stem, and said latch having a second position to allow said arm to pivot relative to said body to activate said valve stem in a second state of activation;

a shaft connected with said body and extending into said arm aperture providing an angular stop for said arm; and a roller rotatably connected to said body for contacting a cam lobe in said second state of activation.

2. A multiple lift position rocker arm assembly as described in claim 1, wherein said shaft provides a lower angular stop for said arm.

3. A multiple lift position rocker arm assembly as described in claim 1, wherein said shaft is an upper stop for said arm.

4. A multiple lift rocker arm assembly as described in claim 3, wherein said arm is held out of engagement with a base circle of said cam lobe.

5. A multiple lift position rocker arm assembly as described in claim 1, wherein said shaft rotatably mounts said roller.

6. A multiple lift position rocker arm assembly as described in claim 5, wherein there are two rollers mounted on said shaft and said rollers are separated by said arm.

7. A multiple lift position rocker arm assembly as described in claim 1, wherein said arm has rotatably connected thereto a roller for making contact with said cam lobe.

8. A multiple lift position rocker arm assembly as described in claim 7, wherein said arm has rotatably connected thereto a roller for making contact with said cam lobe and when said arm is at an upper extreme position, said roller connected with said arm and said roller connected with said body and said cam shaft have rotational axis on a common plane.

9. A multiple lift position rocker arm assembly as described in claim 1, wherein said arm is engagable with a first cam lobe on a first camshaft and said roller rotatably connected on said body is engagable with a second cam lobe rotatably mounted on said first camshaft.

10. A multiple lift position rocker arm assembly as described in claim 7, wherein said roller connected to said arm has a hollow portion coterminous with said aperture of said arm and said shaft rotatably mounts said roller connected to said body.

11. A multiple lift position rocker arm assembly as described in claim 7, wherein said arm has said roller connected between forked lobes.

12. A multiple lift position rocker arm assembly as described in claim 5, wherein said shaft is press-fitted into said body.

13. A multiple lift position rocker arm assembly as described in claim 1, wherein said arm has a slider for making contact with said cam lobe.

14. A multiple lift position rocker arm assembly as described in claim 13, wherein said slider has a radius of curvature which is along a plane which generally intersects a radius of said roller connected on said body and a radius of said cam lobe when said arm is positioned in an extreme upper position.

15. A multiple lift position rocker arm assembly as described in claim 1, wherein said roller connected to said body has bearing members between said roller and said shaft.

16. A multiple lift rocker arm assembly as described in claim 15, wherein said shaft at its end has a cover which retains said bearing members between said roller and said shaft.

17. A multiple lift position rocker arm assembly as described in claim 7, wherein said roller connected to said arm has a sleeve press-fitted within an aperture and said arm roller has needle bearings between said arm roller and said sleeve.

18. A multiple lift position rocker arm assembly as described in claim 7, wherein said roller connected on said arm is for engagement with a high lift cam lobe and said roller connected on said body is for engagement with a low lift cam lobe and wherein said arm in said uppermost position is positioned out of contact with a base circle of said high lift cam lobe.

19. A multiple lift position rocker arm assembly as described in claim 13, wherein said slider makes contact with a high lift cam lobe and said roller on said body makes contact with a low lift cam lobe and at an extreme upper position said slider is positioned out of contact with a base circle of said high lift cam lobe.

20. A multiple lift rocker arm assembly as described in claim 1, wherein said body roller is mounted within enclosing pockets formed with said body.

21. A multiple lift position engine rocker arm assembly comprising:

a fork-shaped body engagable adjacent a first end with a valve stem, said body being engagable with a fulcrum adjacent an end opposite said first end;

an arm pivotally connected to one of said ends of said body, said arm being spring-biased into engagement with a cam lobe, said arm having a roller rotatably connected thereto;

a latch connected on the end of said body, generally opposite said arm pivotal connection with said body, said latch having a first position to prevent angular movement of said arm with respect to said body in a first given angular direction to transmit movement of said arm by said cam lobe to said body for a first state of activation of said valve stem, and said latch having a second position to allow said arm to pivot relative to said body to activate said valve stem in a second state of activation; and second and third rollers connected with said body and connected on coterminous shafts for contacting a cam lobe in said second state of activation, said second and third rollers being separated by said first roller.

22. A multiple lift position engine rocker arm assembly comprising:

a body having forked lobes and being engagable adjacent a first end with a valve stem, said body being engagable with a fulcrum adjacent an end opposite said first end;

a forked arm pivotally connected to one of said ends of said body between said lobes of said body, said arm being spring-biased into engagement with a cam lobe, said arm having aligned apertures through said lobes of said arm;

a sleeve fitted within said aperture of said arm;

a roller rotatably mounted on said sleeve between said lobes of said arm for providing rolling engagement with said cam lobe said arm has engagement with;

a latch connected on an end of said body generally opposite said arm pivotal connection to prevent angular movement of said arm with respect to said body in a first given angular direction to transmit movement of said arm by said cam to said body for a first state of activation of said valve stem, and said latch having a second position to allow said arm to pivot relative to said body to actuate said valve stem in a second state of activation;

a shaft connected with said lobes and extending into said arm aperture providing an angular stop for said arm; and rollers rotatably connected on said body for contacting a cam lobe in said second state of activation, said rollers being outboard of said body.

* * * * *